US008584599B2

(12) United States Patent
Sosa Bravo

(10) Patent No.: US 8,584,599 B2
(45) Date of Patent: Nov. 19, 2013

(54) PLASTIC PALLET

(75) Inventor: Sergio Sosa Bravo, Alton, TX (US)

(73) Assignee: Plasticos Tecnicos Mexicanos, S.A. DE C.V., San Juan del Rio, Queretaro (MX)

( * ) Notice: Subject to any disclaimer, the term of this patent is extended or adjusted under 35 U.S.C. 154(b) by 0 days.

(21) Appl. No.: 12/866,336

(22) PCT Filed: Feb. 6, 2008

(86) PCT No.: PCT/MX2008/000015

§ 371 (c)(1),
(2), (4) Date: Feb. 15, 2011

(87) PCT Pub. No.: WO2009/099314

PCT Pub. Date: Aug. 13, 2009

(65) Prior Publication Data

US 2011/0126741 A1 Jun. 2, 2011

(51) Int. Cl.
*B65D 19/00* (2006.01)

(52) U.S. Cl.
USPC ..... 108/56.3; 108/57.26; 108/901; 108/902

(58) Field of Classification Search
USPC ..... 108/901, 56.1, 56, 3, 57.25, 902, 51.11, 108/57.26; 206/386, 595, 596, 598, 599, 206/600
See application file for complete search history.

(56) References Cited

U.S. PATENT DOCUMENTS

| | | | | |
|---|---|---|---|---|
| 3,832,955 | A | | 9/1974 | Pottinger et al. |
| 4,051,784 | A | | 10/1977 | Ries |
| 4,259,274 | A | | 3/1981 | Tiitola |
| 4,316,419 | A | | 2/1982 | Cupido |
| 4,397,998 | A | | 8/1983 | De La Mare et al. |
| 4,597,338 | A | * | 7/1986 | Kreeger ..... 108/57.26 |
| 5,046,434 | A | | 9/1991 | Breezer et al. |
| 5,186,777 | A | | 2/1993 | Perenon et al. |
| 5,417,167 | A | | 5/1995 | Sadr |
| 5,483,899 | A | * | 1/1996 | Christie ..... 108/56.3 |
| 5,744,077 | A | | 4/1998 | Grisch et al. |
| 6,006,677 | A | | 12/1999 | Apps et al. |
| 6,029,583 | A | * | 2/2000 | LeTrudet ..... 108/57.25 |
| 6,093,358 | A | | 7/2000 | Schiewe et al. |
| 6,103,348 | A | | 8/2000 | Scharrenberg et al. |
| 6,199,488 | B1 | | 3/2001 | Favaron et al. |

(Continued)

FOREIGN PATENT DOCUMENTS

| | | | |
|---|---|---|---|
| EP | 0647513 | A2 | 4/1995 |
| ES | 454107 | A1 | 2/1978 |

(Continued)

*Primary Examiner* — Janet M Wilkens
(74) *Attorney, Agent, or Firm* — The Webb Law Firm

(57) ABSTRACT

A pallet is formed from a thermoplastic material of the polyolefin type, from two pieces, base and deck, that can be coupled to each other with fasteners therebetween. The base and deck are provided with posts each projecting in a direction towards the other and able to be coupled to each other in order to form hollow columns. The posts projecting from the base form the outer wall of a plurality of columns, and the posts projecting from the deck are located at the interior of the columns, forming the inner wall thereof and thus constituting a hollow passage between the outer and inner walls of the columns. The hollow space is filled up with a foamed material to provide a greater impact resistance and resistance to disassembly under normal conditions of operation. The pallet can be integrally recycled without the need to separate the components thereof.

18 Claims, 11 Drawing Sheets

(56) References Cited

U.S. PATENT DOCUMENTS

| | | | |
|---|---|---|---|
| 6,295,787 | B1 | 10/2001 | Lee |
| 6,378,933 | B1 | 4/2002 | Schoen et al. |
| 6,406,078 | B1 | 6/2002 | Wycech |
| 6,422,575 | B1 | 7/2002 | Czaplicki et al. |
| 6,423,755 | B1 | 7/2002 | Allen et al. |
| 6,451,231 | B1 | 9/2002 | Harrison et al. |
| 6,619,727 | B1 | 9/2003 | Barz et al. |
| 6,705,237 | B2 | 3/2004 | Moore, Jr. et al. |
| 6,938,558 | B1 | 9/2005 | Peres |
| 6,976,437 | B2 | 12/2005 | Fisch et al. |
| 7,168,590 | B2 | 1/2007 | Jones et al. |
| 2002/0074827 | A1 | 6/2002 | Fitzgerald et al. |
| 2003/0137162 | A1 | 7/2003 | Kropfeld |
| 2003/0184121 | A1 | 10/2003 | Czaplicki et al. |
| 2003/0209921 | A1 | 11/2003 | Coon et al. |
| 2004/0255546 | A1 | 12/2004 | Sophiea et al. |
| 2006/0154028 | A1 | 7/2006 | Dooley et al. |
| 2006/0236903 | A1 | 10/2006 | Moore, Jr. |
| 2006/0249058 | A1 | 11/2006 | Moore, Jr. et al. |
| 2007/0023945 | A1 | 2/2007 | Valentinsson |
| 2007/0028814 | A1 | 2/2007 | Swistak et al. |
| 2007/0234933 | A1* | 10/2007 | Donnell et al. ..... 108/56.3 |
| 2007/0275229 | A1* | 11/2007 | Laws et al. ..... 428/318.8 |
| 2008/0113056 | A1 | 5/2008 | Schnurr |

FOREIGN PATENT DOCUMENTS

| | | | |
|---|---|---|---|
| ES | 2177070 | T3 | 12/2002 |
| FR | 2697801 | * | 5/1994 |
| GB | 1335688 | A | 10/1973 |
| JP | 2000309059 | * | 4/1999 |
| WO | WO 02/074843 | * | 9/2002 |

* cited by examiner

PLASTIC PALLET

FIELD OF THE INVENTION

This invention relates to plastic racks of the type employed for loading and transporting commodities, and specially relates to such racks also known as pallets.

BACKGROUND OF THE INVENTION

There is within the industrial premises high dynamics for loading, unloading and moving both inputs and outputs, which generally are piled onto plastic pallets to be moved by lifts. Said operations are generally carried out at a great speed, with the consequence of frequent impact of the pallets with the probes of said lifts and eventually said goods fall down from different heights. Therefore, the damages in the pallets are not only frequent, but an everyday problem and even more, a great amount of the damages result in the discarding of the pallets, whereby the replacement rate of said pallets is generally high, which to a certain measure influences the costs of operation of industries.

Several attempts have been carried out in order to provide pallets more resistant to impacts so, a great amount of patents related to this type of pallets can be found protecting several forms of pallets or pallets, as well as the process of obtaining the same; for instance, the US patent application No. 2007/0028814 A1, to Swistak and Moore, discloses "a pallet having segments for multiple purposes, wherein a portion to be filled with injected foam is included, wherein there is at least an injected foam hole, selectively disposed at the lower surface, so-called an interior hollow portion, provides at least a foam injection hole to seal said hole so that at least one element is projected downstream from at least a foam injection hole." The pallet disclosed in said document allows the assembly of said pallet one upon another without problems, and furthermore, allows the injection of foam within special zones located near the columns of said pallets. The invention disclosed in the Swistak document has the disadvantage of using thermosetting foamed materials, which does not provides for the recycling of said pallet in a whole, and, furthermore, the material thereof is of high cost.

On the other side, the US patent application No. 2006/0236903 to Moore describes a hollow thermoplastic member or pallet, that can be made from polypropylene (PP) or high-density polyethylene (HDPE), having spaces in some zones of the pallet, such as the columns thereof, that can be filled with thermosetting polymer foam, such as polyurethane, low-density polyurethane foam, ceramics, glass or an expandable mineral foam; said foam having also a fire-retardant the characteristic of which is additional in said plastic pallet. The disadvantage of the product described by Moore et al is that the production of this type of pallet, when using a thermosetting polymer foam is consequently more expensive and has a greater production time; also, as it is known, this type of plastics are hardly recyclable.

Moore describes also in U.S. Pat. No. 6,705,237 a pallet including an upper deck, a support material arranged within said upper deck; an upper structure member supporting said upper deck; a plurality of foot or column members arranged on said upper structure member; and a lower structure member arranged on said plurality of foot or column members. Said upper deck includes a first half and a second half, arranged in communication with a greater surface of the first half; said pallet having several variations and being foldable or includes reinforce members within the reach of the pallet disclosed in said document. Due to the characteristics described in said Moore patent document, the production of said pallet is considered highly expensive and with a high production time and, additionally, the type of material utilized is not considered as recyclable.

Swistak U.S. patent application No. 20070028814 discloses a platform of the type described by Moore, including additionally orifices for the injection of foam, selectively located at the lower surfaces of the platform columns. Plugs are employed to seal the foam filling holes as well as the vents. In an additional embodiment, said plugs project from the surface of the platform and are coupled to grooves in the deck of a second platform, so as to prevent the movement of the platforms piled up on one another.

The production methods of plastic pallets also cover a great variety of alternatives; for instance, U.S. Pat. No. 5,417,167 (Sadr, 1995) teaches a plastic platform formed from string pieces and hollow plastic boards of plastic material that can be any virgin plastic, recycled plastics or a mixture thereof; and are formed by blow molding. Said string pieces and boards are hollow but have their ends closed up so as to prevent the admission of dirty, liquids or insects. Various alternatives are disclosed for the coupling between the parts, including the screw securing as well as connections joining said plastic pieces to one another, and the use of components separately coupled to the board and the string pieces. A similar technique is disclosed in U.S. Pat. No. 6,976,437 (Fisch et al, 2005).

U.S. Pat. No. 6,938,558 (Peres, 2005) describes a blow-molded plastic platform constituted by two parts, including ribbons fastened on the string pieces due to the sliding and coupling of the trail type. Said upper and lower surfaces of the string piece are plain and improve the distribution of the load.

Alternatively, the plastic platforms can be formed from separated apart upper and lower docks that are connected and locked in a certain manner, for instance, by mechanic means. Said upper and lower docks, independently, have each characteristic connecting means to be coupled; this technique for the pallets having the disadvantage of the cost of said two separated apart molds. Additionally, the impact to the platform during the use, such as, for example, of a forklift, can cause the side movement of the upper and lower decks, one relating another, resulting in the separation of said docks. Moreover, said platforms can be vulnerable to applied forces along the connection line between said upper and lower decks; therefore, there is the need of a platform more resistant to the impact along the connecting line, capable of provide securer coupling characteristics so as to prevent the separation of said decks.

Consequently, there is a great need to increase the resistance of the pallets to the impact provoked during their use, as well as to prevent the disassembling of both parts, whereby a low cost production and a 100% recyclable product are obtained.

Some modifications to the basic design of a platform include the addition, for instance, of anti-slipping surfaces, as shown in U.S. Pat. No. 4,051,784 (Nishitani et al, 1977), that teaches a plastic platform having a surface provided of a member of an anti-slipping layer made of gum; or U.S. Pat. No. 6,006,677 (Apps et al., 1999), that provides a platform made of synthetic resin with a textured surface, formed by scratch-brushing the surface with a wire brush. Said documents fail in pretending to obtain an anti-slipping surface due to the fact that, on the one side, said Nishitani document shows a gum layer attached and, on the other side, said pallet with anti-slipping surface described by Apps is a surface that must be brushed in order to obtain a rough zone which, in both cases and in a general manner, this object is hardly attained;

and furthermore, they are not products resisting the impacts to be supported by said pallets daily.

SUMMARY OF THE INVENTION

It is the main object of this invention to provide a reinforced plastic pallet with a great resistance to the impacts experienced during the use thereof, such as those caused by tires, rims, probes and guides of a lift.

Another object of the present invention is to provide a plastic pallet supporting a more freight compared to conventional pallets.

Another object of the present invention is to provide a plastic pallet that can be wholly recyclable.

A further object of the present invention is to provide a pallet having anti-slipping edges that also are useful to bear side impacts.

These and other further objects are attained by the pallet of this invention, referred to as a rack or pallet, formed from a plastic material, preferably a thermoplastic selected from the group of polyolefins including low-density polyethylene (LDPE), high-density polyethylene (HDPE), polypropylene (PP) and mixtures thereof.

The plastic pallet of the present invention is constituted by two structures: a base and a deck, capable of being coupled to each other, and forming thus a body offering an upper surface to support the commodities to be translated; a lower surface on which the body of the pallet rests, and at least four peripheral column and one central column, preferably eight peripheral columns and one central column, arranged between said upper and lower surfaces.

The base structure includes at least four peripheral posts and a central post; there being provided said deck structure with posts corresponding to each of the base posts, so that, in a coupled position, each of the base posts can be coupled to the deck post correspondingly positioned, thus forming said peripheral and central columns. Additionally, when said base structure is coupled to said deck structure, in every peripheral column and central column will be provided an outer wall and an inner wall, separated apart by a space wherein a foamed thermoplastic material packing is introduced, selected from the group of polyolefins including low-density polyethylene (LDPE), high-density polyethylene (HDPE), polypropylene (PP) and mixtures thereof. The function of the foamed material packing is to reinforce said columns, so as to increase the load capacity, as well as to absorb the impacts exerted on said plastic pallet during its everyday use, without a considerable increment in the total weight of said plastic pallet. Additionally, said foamed packing also provides a secure fastening of the unions between said posts forming said peripheral columns thus avoiding the motion due to the slack existing between said base and said deck, providing a greater fastening to one another, thus avoiding the disassembly of the pallet during the use thereof.

The peripheral posts of said deck include hook-like fastening means corresponding to fastening means in the peripheral posts of the base; with said fastening means maintaining connected said deck and said base upon the coupling of one another in order to constitute the peripheral and central columns of said plastic pallet.

Upon the coupling of said deck with said base columns are formed the outer wall of which corresponds with the base posts and the deck posts and are located at the interior of said peripheral columns, thus constituting the inner wall of a hollow wherein, according to this invention, a foamed packing material is provided, preferably of the group of polyolefins including low-density polyethylene (LDPE), high-density polyethylene (HDPE), polypropylene (PP) and mixtures thereof.

According to the principles of this invention, a pallet provides a suitable functioning of an automatic lift or a lift provided with manual skid, whereby weights above 1700 Kg can be supported, loaded and moved, with a very intense traffic with the distribution and storage warehouses. It is to be considered that the maneuvers with the plastic pallet when loading commodities into the trucks is carried out to a relatively high speed, whereby said plastic pallet is constantly impacted with the probes of said lifts. The design proposed herein diminishes the effect of said impacts on the integrity of the plastic pallet, thus increasing the useful life thereof and reducing the need for a frequent replacement. Likewise, at the upper part of said plastic pallet edges can be provided conferring a characteristic that prevents the sliding of the payload elements places onto said pallet during the transportation thereof.

Due to the operation conditions in the above referred to application, there is a great need of avoiding that the parts forming the body of the pallet become disassembled during the everyday use, further to increase the resistance to impacts provided by said lifts. This object is obtained in this invention, which provides a pallet with a body formed by at least two assembled and molded plastic structures forming a base and a deck, in such a manner that a space is provided within the columns, in which a foamed thermoplastic material packing is provided; wherein the material of the packing, as well as that of the base and of the deck, are selected from the polyolefins family (lo-density polyethylene, high-density polyethylene, propylene and mixtures thereof); preferable being the same material for every component, whereby, at the end of the useful life of the pallet,—that will be greater than that of the conventional pallets—, the pallet can be wholly recycled there being no necessary to carry out a materials separation.

These and other further objects can be clearer to the light of the following disclosure and the appended drawings.

DETAILED DESCRIPTION OF THE INVENTION

The present invention refers to an improved pallet or plastic rack molded from a thermoplastic material, preferably selected from the group of polyolefins including, among other, low-density polyethylene (LDPE), high-density polyethylene (HDPE), polypropylene (PP) and mixtures thereof.

Figure 1:
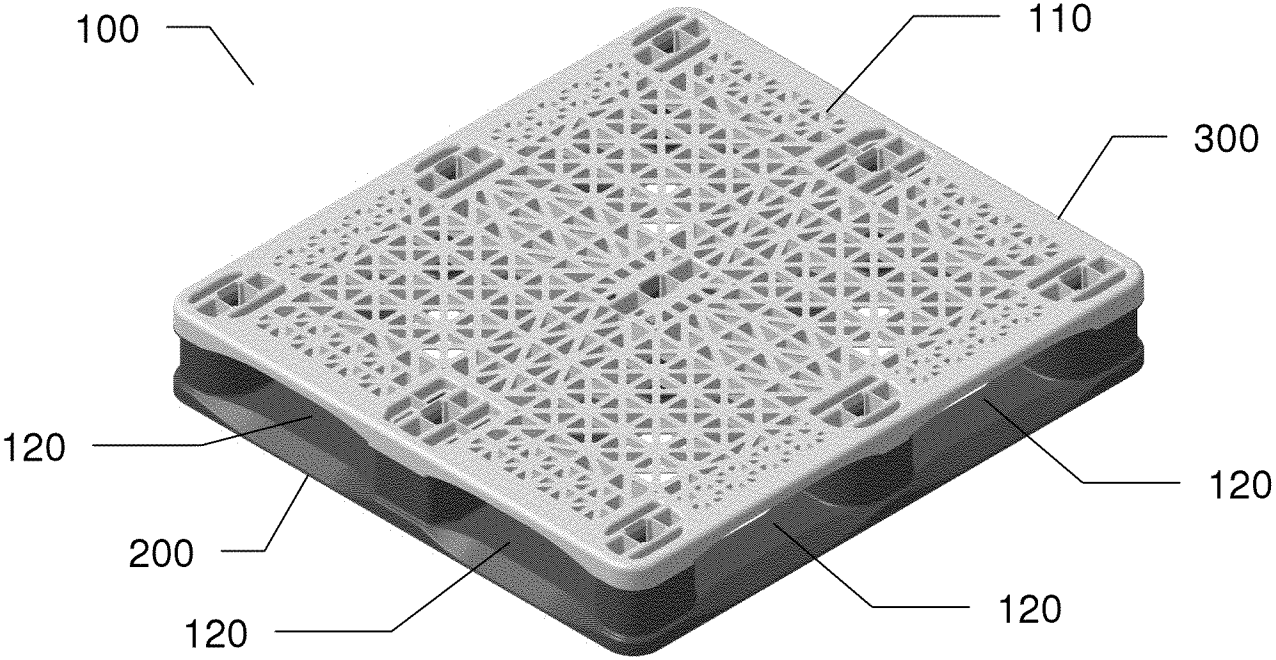
FIG. 1 shows a simple perspective view of a pallet of this invention.

The body of the plastic pallet 100 of this invention, as shown in FIG. 1, is constituted by two molded structures forming a base 200 and a deck 300, assembled to one another in order to form a body 100 offering a surface 110 to support the object to be translated; said surface 110 offer preferably bores passing there through so as to provide for the draining of the liquids spilled on said surface, in order to clean and lighten the structure, and a plurality of side hollows 120 to provide for the passing of the freight "probes of the lift, for translating said plastic pallets and the objects deposited thereon. Preferably the corners of said pallet 100 of the invention are rounded.

Figure 2:
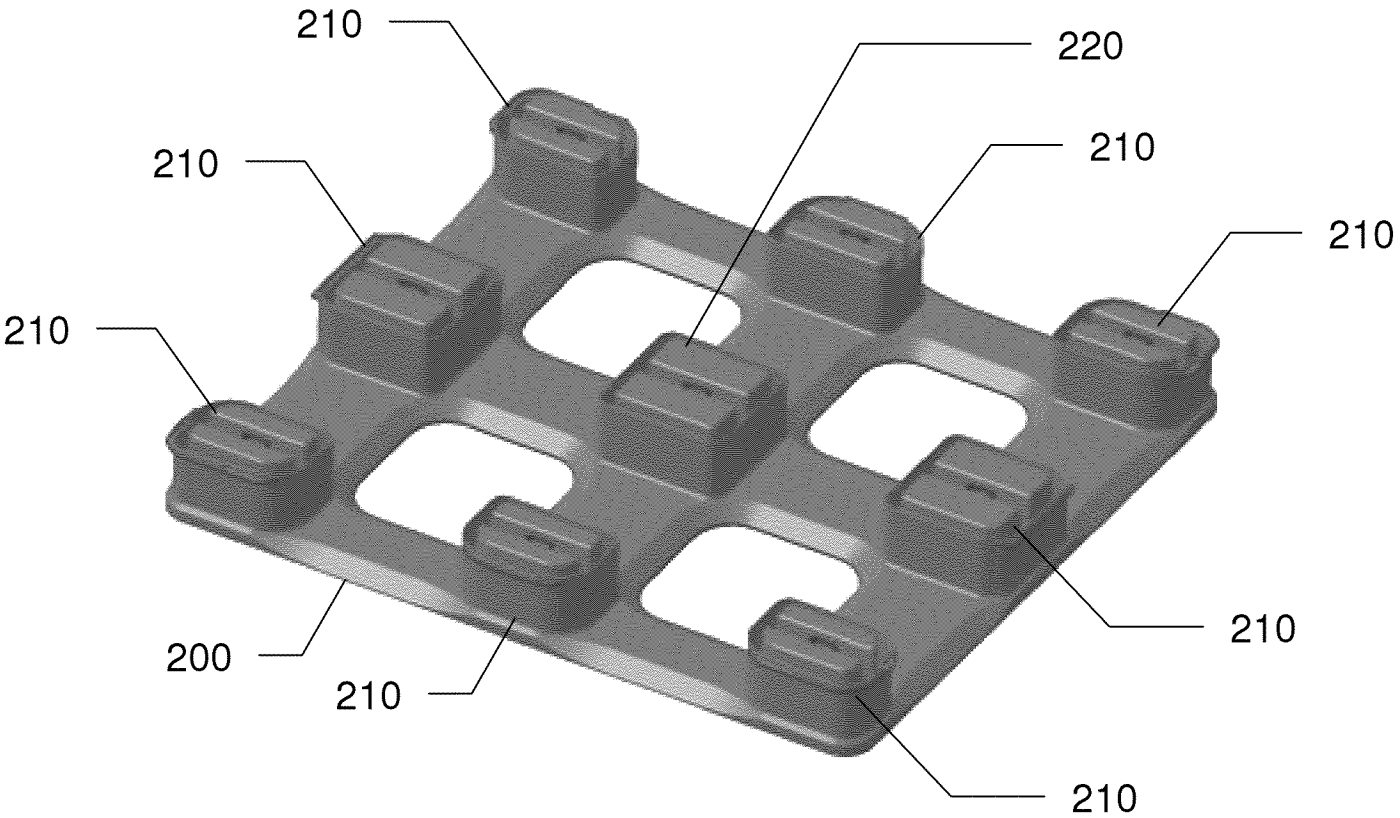
FIG. 2 shows a simple perspective view of the base of the pallet of this invention.

Said base 200 includes at least four posts 210 situated at the corners, although the preferred embodiment includes eight posts 210, situated at the corners of the body and at the mean zone of the sides of said base 200, and a central post 220, situated at the center of the base 200, as appears from FIG. 2. The outer surfaces of said posts 210 and 220 will constitute the outer wall of a plurality of columns connecting with said deck 300.

Figure 3:
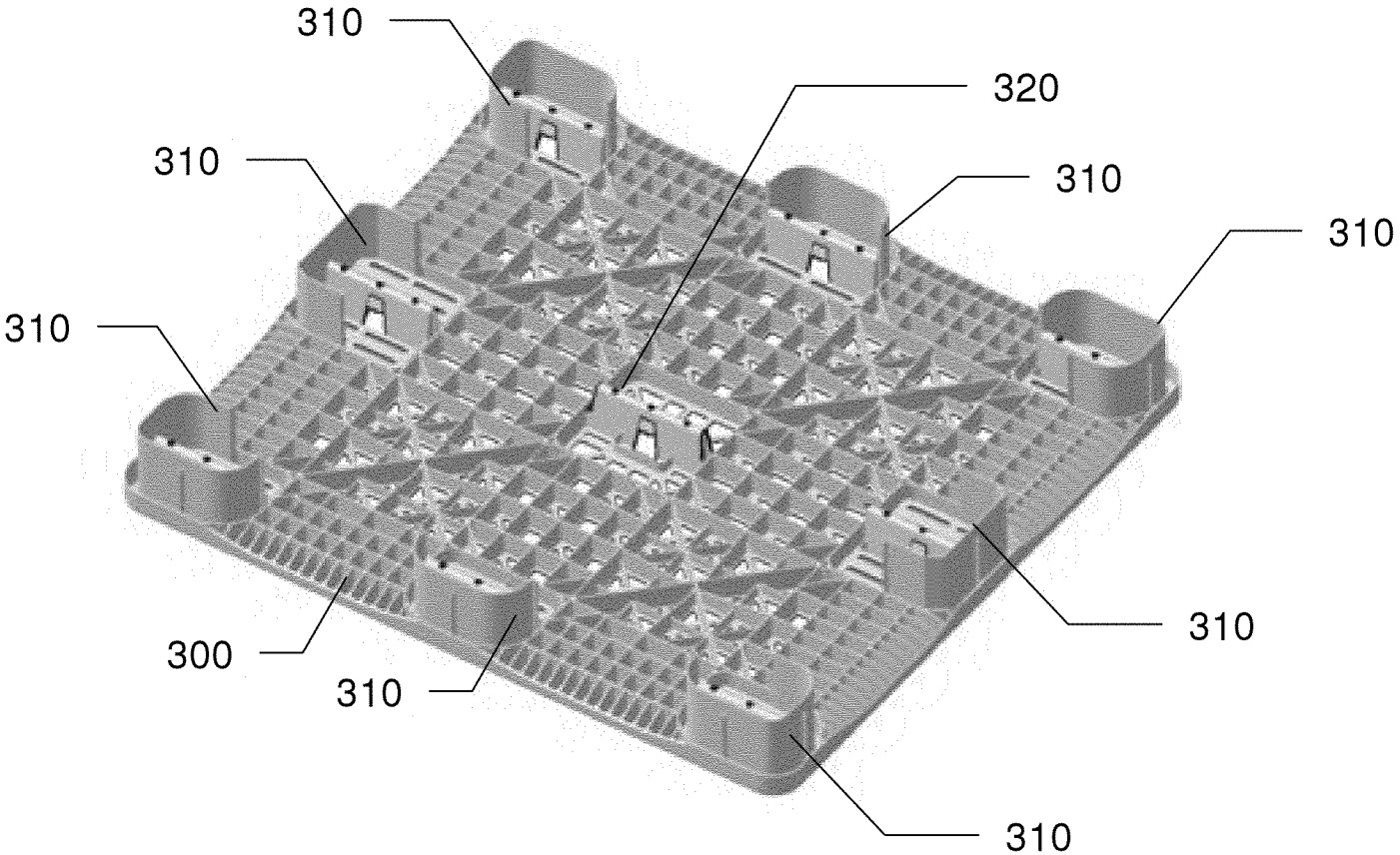
FIG. 3 shows a simple perspective view of the deck of the pallet of this invention.
Figure 4:
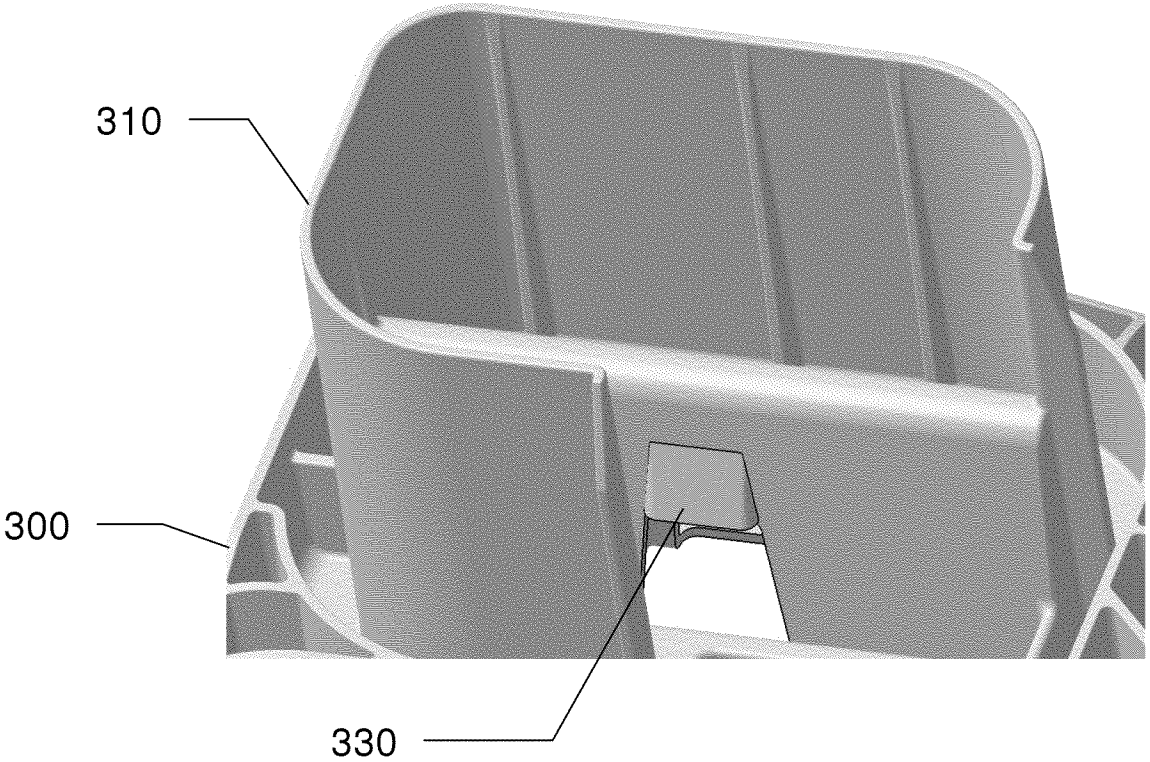
FIG. 4 is a detailed view of a peripheral post of the deck in the pallet of this invention.

The peripheral posts 210 of said base 200 correspond to each other with those peripheral posts 310 in the deck 300, as illustrated in FIG. 3, projecting from the lower surface of said deck 300 towards the base of the pallet; at the central position of said deck 300 are shown only the securing means 320 to be coupled with the corresponding fastening means in the central post 220 of said base, whereby the central column will be constituted. As can be seen in FIG. 4, all of the peripheral posts 310 in said deck 300 include securing means 330 in the shape of hooks, suitable to keep connected said deck 300 and base 200 once they are coupled to each other in order to form the body of said plastic pallet 100, as schematically shown in FIG. 5.

Figure 5:
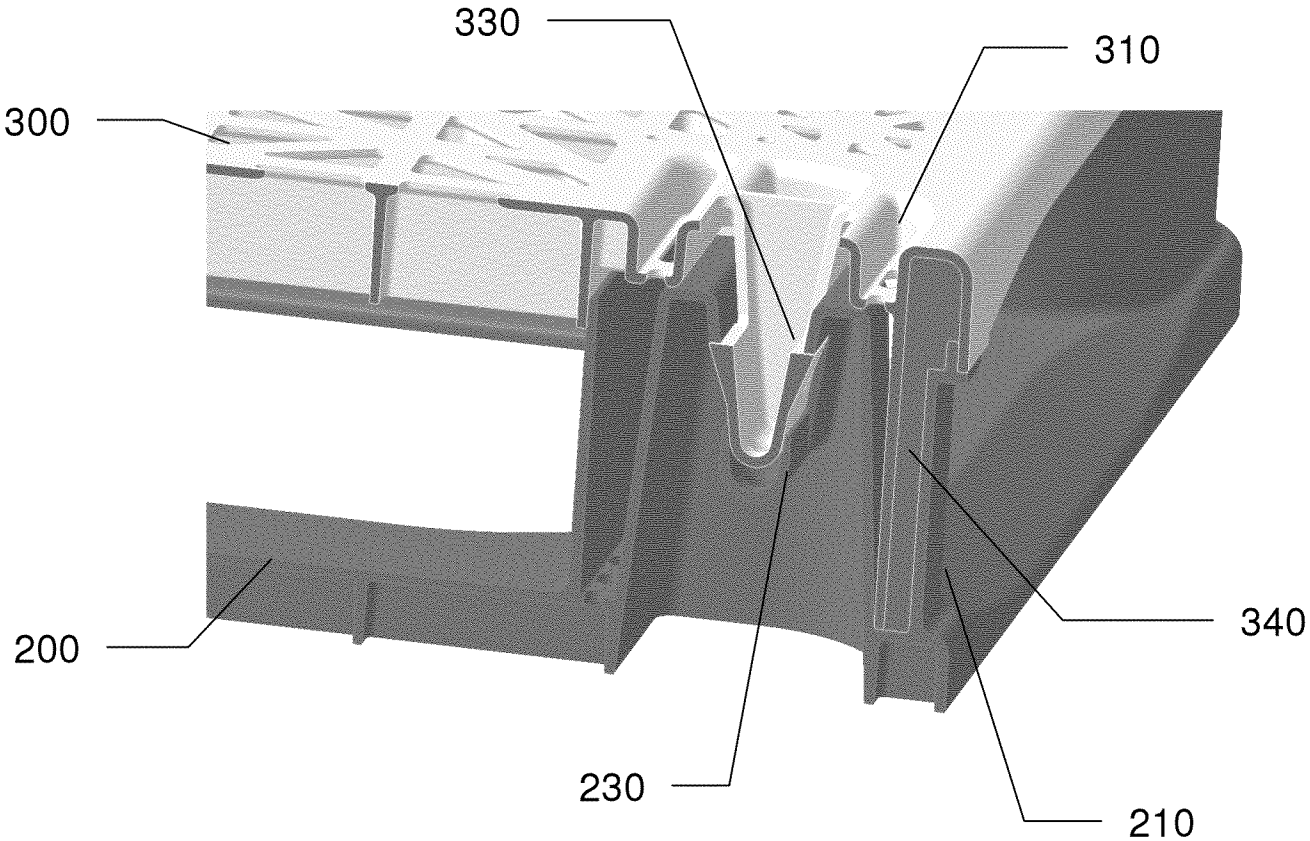
FIG. 5 is a detailed cross-sectional view of the coupling between a deck and a base in a pallet of this invention.
Figure 6:
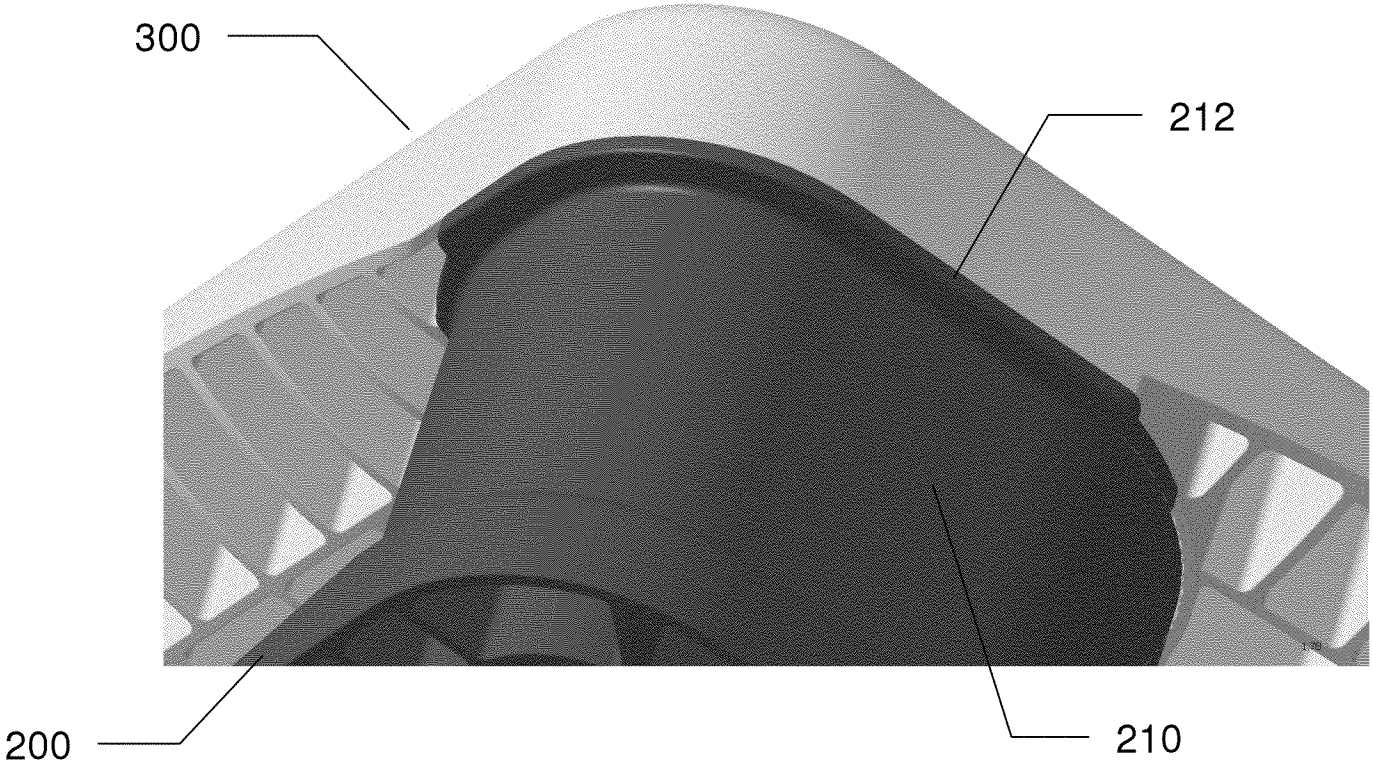
FIG. 6 is a view of the exterior of a column produce upon the coupling of the deck and the base of a pallet of this invention, wherein it can be seen that said deck bears on a ridge 212 at the upper end of the base post.
Figure 7:
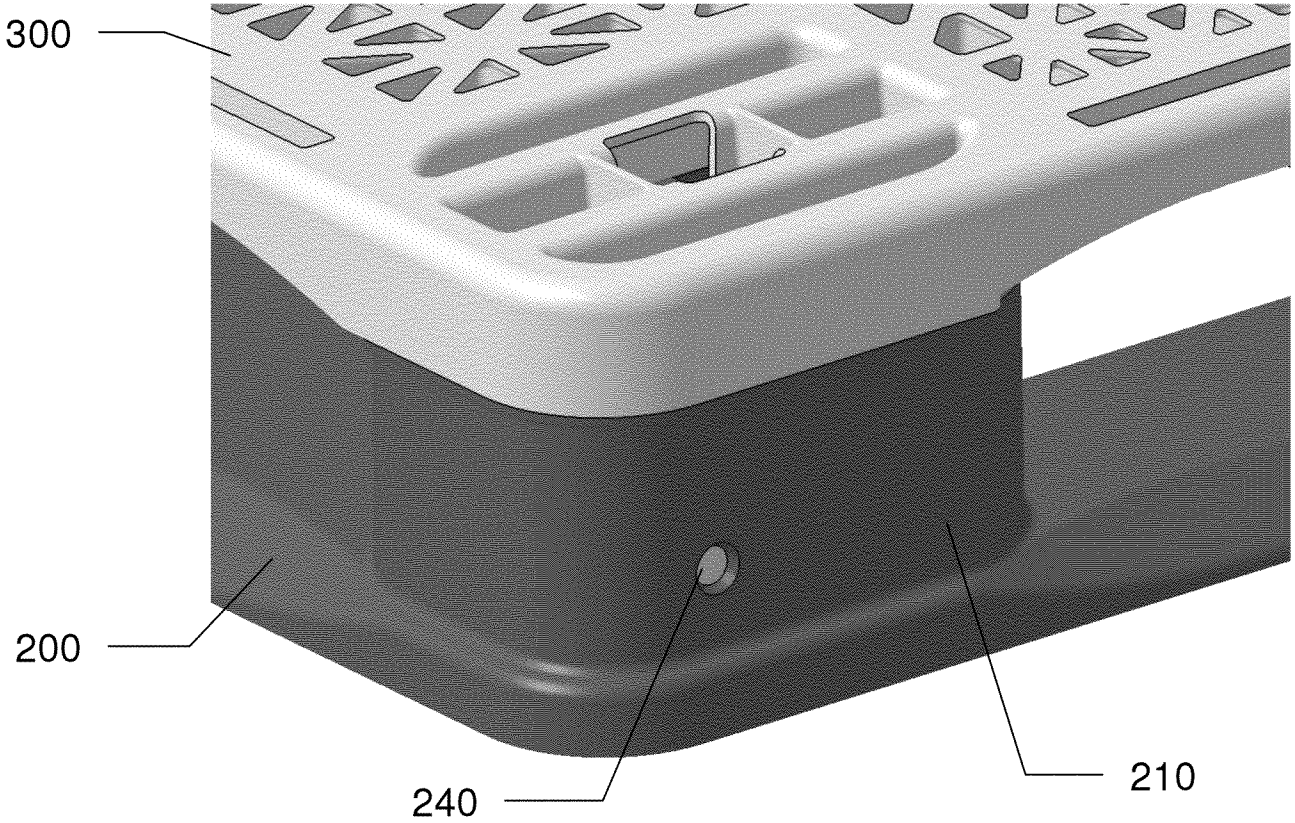
FIG. 7 is a detailed view of a column produced upon the coupling of said deck and said base in the pallet of this invention, showing the orifice for the filling up with a foamed material.
Figure 8:
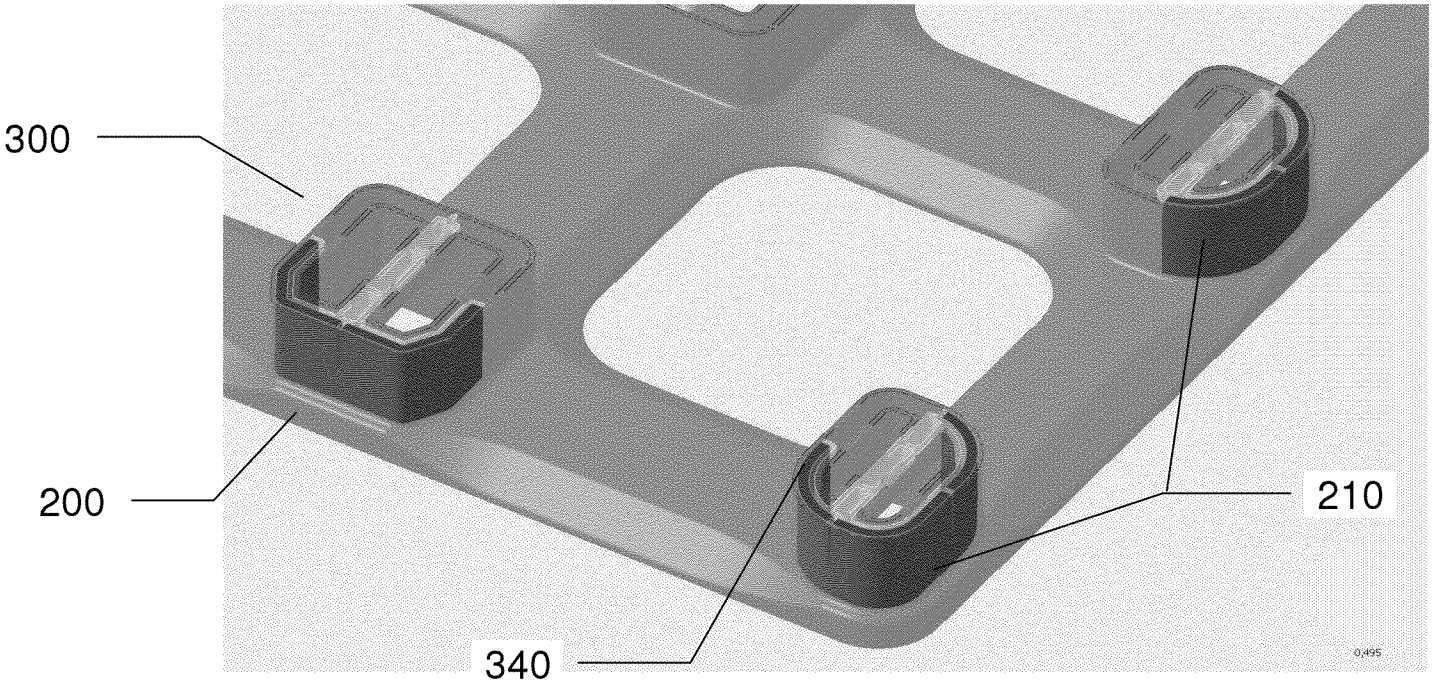
FIG. 8 is a detailed cross-sectional view of the columns produced upon coupling of said deck and said base in the pallet of this invention, showing the space designed to the filling up with a foamed material.

Said posts 210 include fastening means 230 cooperating with said securing means 330 in the shape of hooks, projecting from the walls of said posts 310 in said deck 300, by means of which both parts are hooked up during the assembly of said plastic pallet, as shown in the detail of the cross-sectional view of FIG. 5. Once said deck 300 and base 200 coupled to each other, there are formed so many columns as peripheral projections 210 and 310 are provided in said deck 300 and base 200; at least there are four columns, one in every corner, and preferably there are eight columns, one in every corner and another one in the middle portion of each of the sides of said pallet. The outer wall of the columns corresponds each to that of the peripheral posts 210 in the base; and each of the walls of the peripheral posts 310 of the deck, located at the interior of said peripheral posts 210, constitutes the interior wall of an empty space 340 (FIG. 8) wherein, according to this invention, a foamed packing material is introduced, preferably made from a thermoplastic of the same nature as the material used to form said plastic pallet 100 body, i.e., LDPE, HDPE, PP or mixtures thereof.

Figure 9:
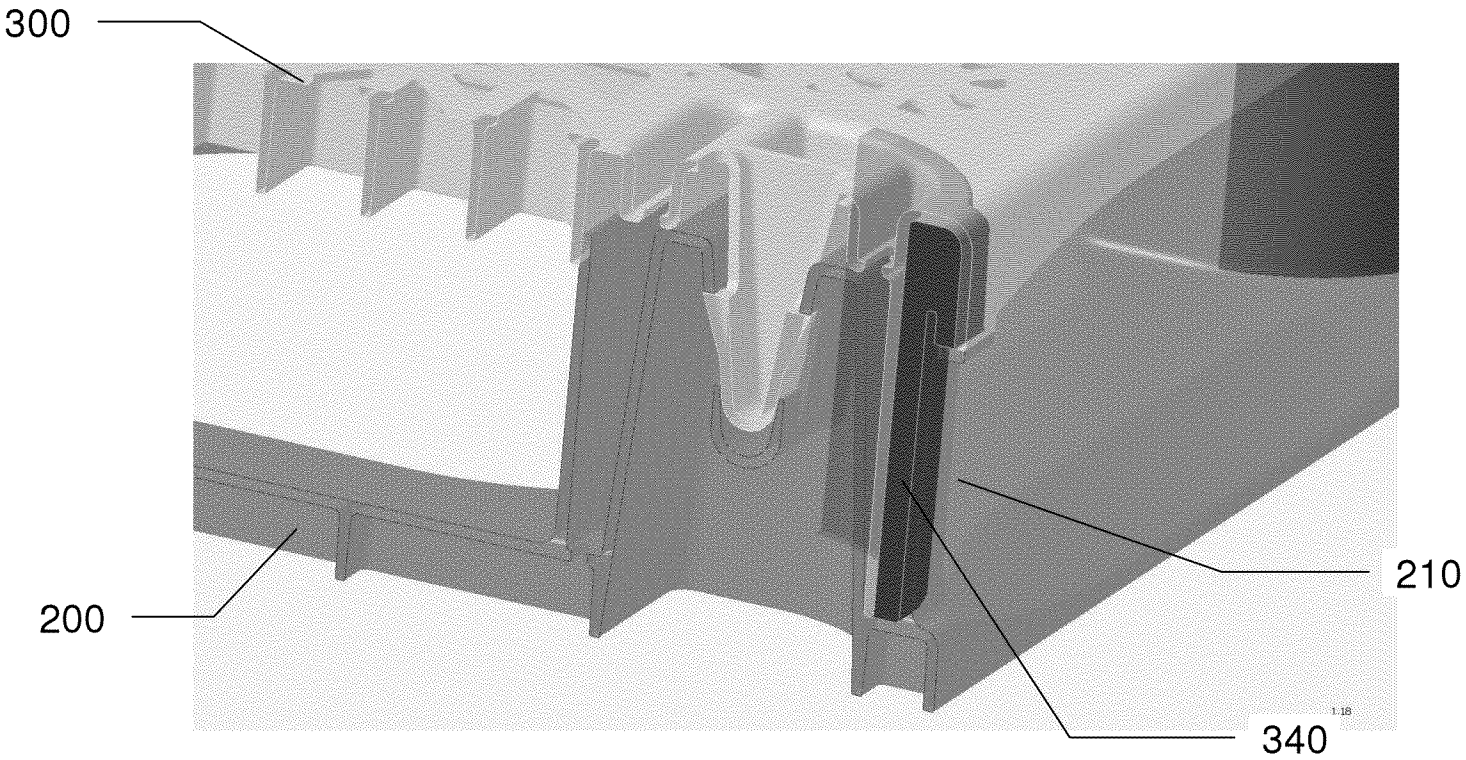
FIG. 9 is a detailed cross-sectional view of a column produce upon the coupling of the deck and the base in a pallet of this invention, showing the space designed to be filled with a foamed material.
Figure 10:
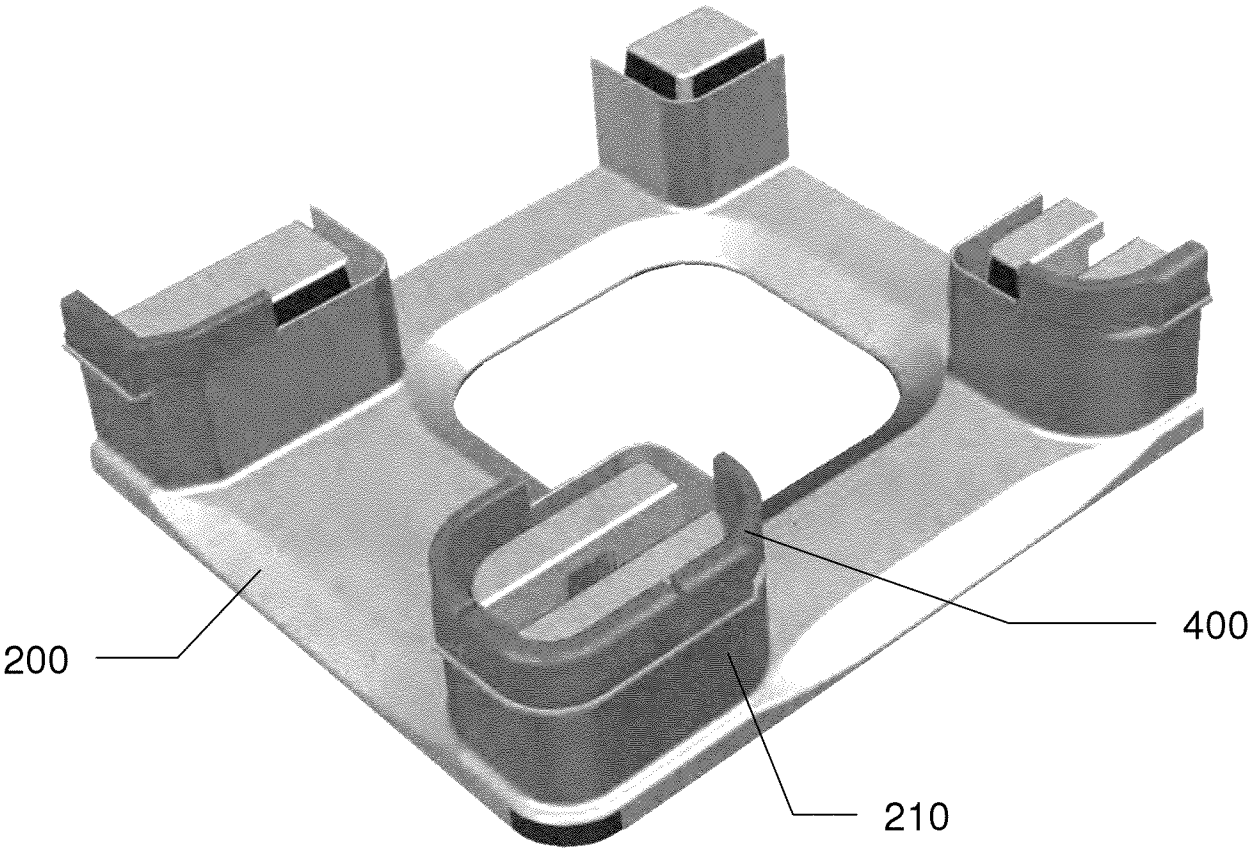
FIG. 10 is a schematic representation of a cross section of one of the columns produced upon the coupling of said deck and said base in the pallet of this invention, showing the packing of foamed material destined to the space between the walls.

It is to be observed that every column has a height determined by the height of the peripheral post 210 and the height of the edge of the deck 300, that bears con a ridge 212 located at the periphery of the upper open end of said post 210, so that the strains applied on the surface of said deck 300 of the already assembled pallet 100 are directly transmitted to the walls of said peripheral posts 210 and thence towards the contact points between the lower surface of the base 200 and the floor or, as the case be, the upper surface of another pallet, when several pallets are piled up. This addressing of strains directly towards the walls of the posts in the base is secured upon designing said walls completely vertical. Due to the strain concentration on the walls of said posts 210 of the base 200 and, therefore, on the walls of the posts 310 in said deck 300, it is necessary to reinforce these zones and, according to this invention, the reinforcement is obtained through the injection of plastic material, that is foamed at the interior of the hollow space 340 between the walls of the posts in the base 210 and the deck 310 (cf. FIGS. 5 and 8); said plastic material being injected to the interior of the hollow space 340 through the orifice 240 located in a zone near the base of said post 210, so that said material can flow around the central post in order to fill said hollow space 340 (FIG. 9), conforming to the shape of said hollow space, as schematically illustrated by the block of foamed material 400 in FIG. 10.

The roll of the packing of foamed material is to reinforce the interior of said columns, in order to increase thus the load capacity, without a considerable increase in the total weight of said pallet, as well as to absorb the impacts experienced by said plastic pallet 100 during the everyday use. It is important to point out that said foamed packing also provides a secure fastening of the connections between said peripheral posts 210 and 310. The central column formed by said projections 220 and securing means 320 is not filled up with foam, as made with the hollow spaces 340 formed by both assemblies of peripheral posts in the deck 310 and the base 210, upon the assembling thereof. By means of the injection of the foamed thermoplastic within said hollow spaces 340 the motion due to the slack existing between the base and the deck, and will provide a greater holding to connection of said base 200 and said deck 300, so as to avoid the disassemble thereof during the use.

As already pointed out, in the preferred embodiment of the invention the material to said foaming, and also that of the base and the deck, is selected from the family of polyolefins (low-density polyethylene, high density polyethylene, polypropylene and mixtures thereof), being the same material in all of these elements, whereby, at the end of the useful life of the plastic pallet, this latter can be recycled without the need of a separation of materials.

Figure 11:
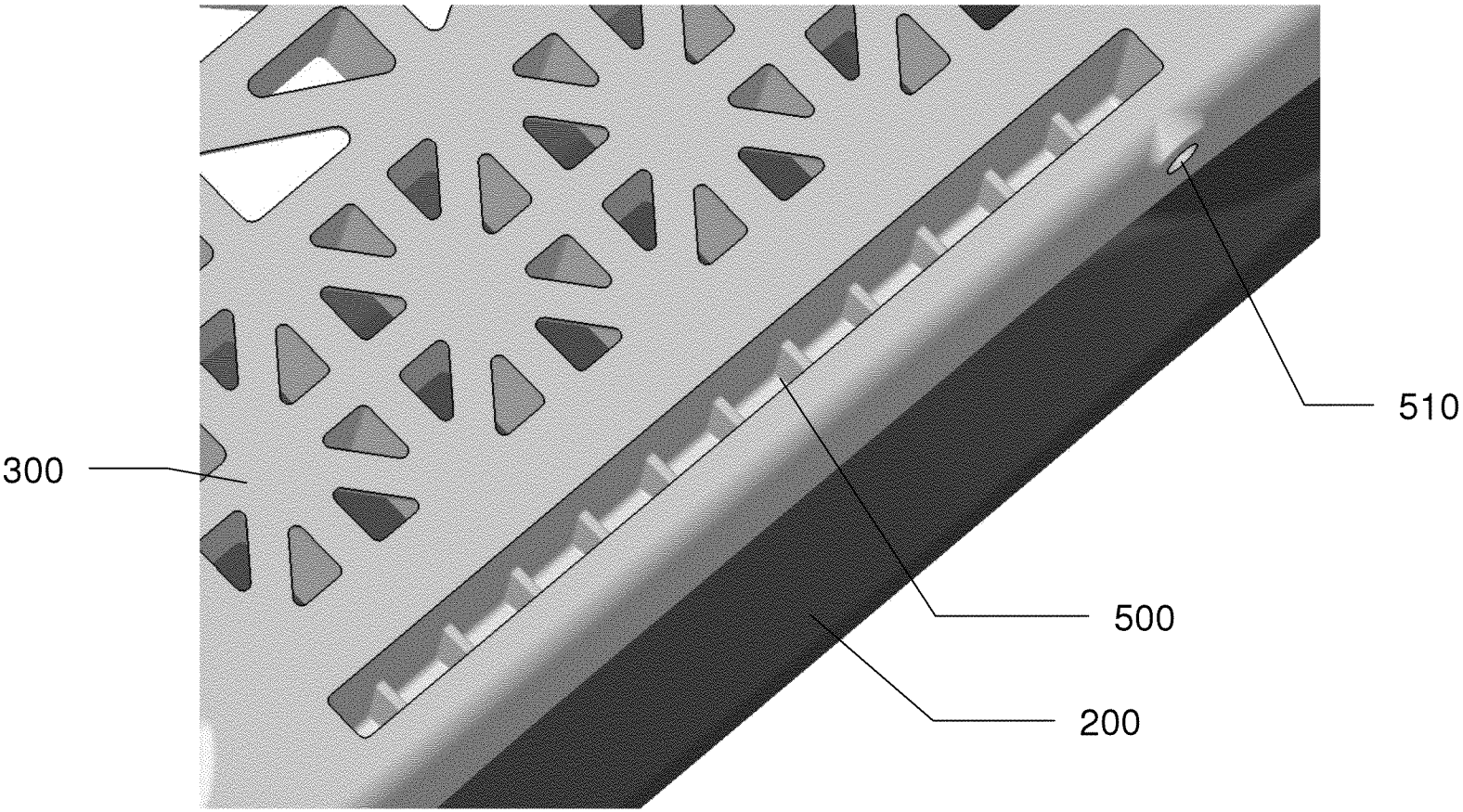
FIG. 11 is a schematic representation of an embodiment of the invention including the injection of material to reinforce the sides of the pallet and to form anti-slipping zones.

In an alternative embodiment of the present invention, and with the purpose of reinforce and protect the sides of the plastic pallet, the foamed thermoplastic material also is injected at the four sides of said deck 300, at those zones defined as near to the edge, as shown by numeral 500 in FIG. 11. This foam injection at the deck (in two sections for every side) is carried out through orifices 510, so that, further to reinforce said areas 500 of the deck, also increases the resistance to the impacts in all the four sides of the plastic pallet altogether and additionally it is possible to generate anti-slipping zones on said deck 300, precisely at the same zones 500 injected, since said foam remains exposed at the exterior thereof. In order to obtain said anti-slipping effect, the material to be injected must be enough elastic, selected from the family of polyolefins (low-density polyethylene (LDPE), high-density polyethylene (HDPE), polypropylene PP and other variants or mixtures of these same materials, in order to keep unaffected the advantage of easy recycling of the materials of said pallet, at the end of their useful life.

Once disclosed and illustrated the preferred embodiments of the present invention, it can be apparent for one skilled in this technical field, that several alternatives can be produced in the configuration thereof, such as, for instance, a change in the number, the position and the shape of the peripheral posts in both the base and the deck, in order to form pallets for specific applications; however, also will be apparent that said modifications remain within the scope of the present invention, as defined by the following claims.

The invention claimed is:

1. A reinforced plastic pallet, comprising:

a body molded from a thermoplastic material, the body being constituted by a base structure and a deck structure configured to be coupled to each other, wherein the body defines an upper surface to support objects on the pallet and a lower surface on which the body of the pallet bears, wherein the base structure includes a plurality of posts directed toward the deck structure and the deck structure includes a plurality of posts directed toward the base structure, each of the plurality of posts of the base structure corresponding with a respective one of the plurality of posts of the deck structure, wherein each of the plurality of posts of the base structure includes a fastening mechanism and each of the plurality of posts of the deck structure includes a securing mechanism, the fastening mechanism of each of the plurality of posts of the base structure being coupled to the securing mechanism of the corresponding one of the plurality of posts of the deck to assemble the pallet, wherein the coupled posts of the base structure and the deck structure form a plurality of columns, each column having an outer wall formed by walls of a respective one of the plurality of posts of the base structure and an inner wall formed by walls of a respective one of the plurality of posts of the deck structure, the outer wall and the inner wall of each column being separated apart to define a space between the outer wall and the inner wall, the base structure and the deck structure covering the space from below and above, respectively, wherein a foamed thermoplastic packing material is applied within the space of each of the plurality of columns to provide support and strength to the columns and provide a greater load capacity and a greater impact absorption to the pallet, and wherein the foamed thermoplastic packing material completely fills the space of each of the plurality columns.

2. The reinforced plastic pallet according to claim 1, wherein the pallet is made from a thermoplastic material selected from the group consisting of polyolefins.

3. The reinforced plastic pallet according to claim 2, wherein the polyolefins can be low-density polyethylene (LDPE), high-density polyethylene (HDPE), polypropylene (PP), and mixtures thereof.

4. The reinforced plastic pallet according to claim 1, wherein the deck structure and the base structure have rounded corners.

5. The reinforced plastic pallet according to claim 1, wherein a portion of the plurality of posts of the base structure and a portion of the plurality of posts of the deck structure are distributed about a periphery of the base structure and the deck structure, respectively, and at least one of the plurality of posts of the base structure and at least one of the plurality of posts of the deck structure are located at a center of the base structure and the deck structure, respectively.

6. The reinforced plastic pallet according to claim 5, wherein a number of posts of the base structure distributed about the periphery of the base structure and a number of corresponding posts of the deck structure distributed about the periphery of the deck structure are four and the posts distributed about the periphery of the base structure and the deck structure are located at the corners of the pallet.

7. The reinforced plastic pallet according to claim 5, wherein a number of posts of the base structure distributed about the periphery of the base structure and a number of corresponding posts of the deck structure distributed about the periphery of the deck structure are eight, and wherein four of the posts distributed about the periphery of the base structure and the deck structure are located at the corners of the pallet and four of the posts distributed about the periphery of the base structure and the deck structure are located at a center of each side of the base structure and the deck structure.

8. The reinforced plastic pallet according to claim 1, wherein the securing mechanism of each of the plurality of posts of the deck structure includes at least one hook and the fastening mechanism of each of the plurality of posts of the base structure is complementary and cooperative with the at least one hook of a corresponding securing mechanism in order to form the body of the plastic pallet and to connect the deck structure to the base structure.

9. The reinforced plastic pallet according to claim 1, wherein the foamed thermoplastic packing material is selected from the group of LDPE, HDPE, PP, or mixtures thereof.

10. The reinforced plastic pallet according to claim 1, wherein the foamed thermoplastic packing material provides a secure fastening between the posts forming the plurality of columns, thus preventing motion between the corresponding posts due to slack existing between the base structure and the deck structure, and an improved fastening between the base structure and the deck structure, thus preventing disassembling of the pallet during use thereof.

11. The reinforced plastic pallet according to claim 1, wherein the foamed thermoplastic packing material reinforces the columns in order to increase the load capacity of the pallet.

12. The reinforced plastic pallet according to claim 1, wherein the foamed thermoplastic packing material reinforces the columns and contributes to the absorption of impacts incident on the pallet during use thereof.

13. The reinforced plastic pallet according to claim 1, wherein the foamed thermoplastic packing material prevents motion between the base structure and the deck structure, providing a secure fastening between the base structure and the deck structure.

14. The reinforced plastic pallet according to claim 1, wherein sides of the plastic pallet are reinforced by injecting foamed thermoplastic material in zones defined in four sides of the deck structure.

15. The reinforced plastic pallet according to claim 14, wherein the foamed thermoplastic material in the four sides of the deck structure is injected in two sections on a side of the deck structure, thus increasing the resistance of the plastic pallet to impacts on the sides of the plastic pallet.

16. The reinforced plastic pallet according to claim 14, wherein the foamed thermoplastic material exposed on a surface of the deck structure of the pallet constitutes anti-slipping zones on the deck structure.

17. The reinforced plastic pallet according to claim 14, wherein the foamed thermoplastic material injected belongs to the family of polyolefins (low-density polyethylene (LDPE), high-density polyethylene (HDPE), polypropylene (PP), and other variants or mixtures thereof.

18. The reinforced plastic pallet according to claim 1, wherein the fastening mechanism of each of the plurality of posts of the base structure is coupled to the respective securing mechanism of each of the plurality of posts of the deck structure within the inner wall of each column.

* * * * *

UNITED STATES PATENT AND TRADEMARK OFFICE

CERTIFICATE OF CORRECTION

PATENT NO. : 8,584,599 B2
APPLICATION NO. : 12/866336
DATED : November 19, 2013
INVENTOR(S) : Sergio Sosa Bravo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 153 days.

Signed and Sealed this
Twenty-second Day of September, 2015

Michelle K. Lee

Michelle K. Lee
*Director of the United States Patent and Trademark Office*